United States Patent [19]

La Marsh et al.

[11] Patent Number: 4,602,781

[45] Date of Patent: Jul. 29, 1986

[54] DUAL ACTION EXERCISE CYCLE

[75] Inventors: Robert D. La Marsh, Alton, Ill.; John Weiss, St. Louis, Mo.

[73] Assignee: Allegheny International Exercise Co., Lincolnton, N.C.

[21] Appl. No.: 479,607

[22] Filed: Mar. 23, 1983

[51] Int. Cl.[4] ..... A63B 21/00

[52] U.S. Cl. ..... 272/73

[58] Field of Search ..... 272/73, 129, 130, 132, 272/126, 135–137; 128/25 R; D21/194; D12/111

[56] References Cited

U.S. PATENT DOCUMENTS

| | | | |
|---|---|---|---|
| D. 209,065 | 10/1967 | Weiss | D21/194 |
| D. 210,958 | 5/1968 | Westborg | 272/73 X |
| D. 230,613 | 3/1974 | Coker | 272/130 X |
| 1,872,256 | 8/1932 | Denny | 272/73 |
| 2,382,841 | 8/1945 | Alexander | 272/73 |
| 2,825,563 | 3/1958 | Lawton | 272/130 |
| 3,024,023 | 3/1962 | Steller | 272/73 |
| 3,485,495 | 12/1969 | Gibbs | 272/73 |
| 3,578,800 | 5/1971 | DiNepi | 272/73 |
| 3,601,395 | 8/1971 | Morgan | 272/73 |
| 3,940,128 | 2/1976 | Ragone | 272/73 |
| 3,995,491 | 12/1976 | Wolfla, II | 272/73 |
| 4,079,931 | 3/1978 | Valentine | 272/73 |
| 4,188,030 | 2/1980 | Hooper | 272/73 |
| 4,275,882 | 6/1981 | Grosser et al. | 272/117 |
| 4,397,462 | 8/1983 | Wilmarth | 272/130 |

FOREIGN PATENT DOCUMENTS

| | | | |
|---|---|---|---|
| 1062738 | 9/1979 | Canada | 272/73 |
| 2003598 | 11/1969 | France | 272/73 |
| 8101662 | 6/1981 | PCT Int'l Appl. | 272/130 |

*Primary Examiner*—Richard J. Apley
*Assistant Examiner*—S. R. Crow
*Attorney, Agent, or Firm*—John K. Williamson; John L. LaPierre

[57] ABSTRACT

A dual action stationary exercise cycle providing independent upper and lower body exercising capability. The cycle, in one embodiment, provides a foot actuated lower body exercising apparatus including multi-sprocket, multi-chain, freewheel, flywheel resulting in a high ratio of flywheel rotation per pedal cranking. Also embraced in the lower body exercising device is an adjustable braking apparatus communicating with the flywheel to provide variable resistance to flywheel rotation which in turn varies the pedaling force required to propel the flywheel. The upper body exercising component of the cycle incorporates a handlebar assembly wherein the handlebar is rotatably connected to a stem and coacts with a variable resistance, piston-cylinder which imparts a force resistive to rotational movement of the handlebar in either the forward or the rearward direction or independently to both forward and rearward directions.

15 Claims, 12 Drawing Figures

DUAL ACTION EXERCISE CYCLE

BACKGROUND OF THE INVENTION

The present invention relates to an improved exercising apparatus and, more particularly, to a dual action stationary exercise cycle which includes an upper body exercising portion including a piston-cylinder coacting with a rotatably mounted handlebar to provide resistance to handlebar rotation and a lower body exercising portion having dual pedal, multi-shaft, multi-drive components, each one of said exercising portion being capable of independent and simultaneous operation.

There are numerous exercise devices and variations thereof available in the marketplace today. Many of such devices are stationary exercise cycles capable of providing the user with lower and upper torso exercise either singly or in combination. Typically illustrative of the most relevant prior art dual exercise cycle type devices which are capable of providing a combination of upper and lower body exercise either independently or simultaneously are U.S. Pat. Nos. 3,601,395 and 1,872,256. While the former patent provides a rotatable handlebar capable of 360° rotation including adjustable tension control and an adjustable tension control foot actuated drive means, this reference does not envision the use of a variable resistance piston-cylinder to govern handlebar rotation nor is there disclosed a multi-drive lower body exercising apparatus. The latter mentioned patent merely discloses a spring adjustable tension control lever for hand operated forward and rearward rocking movement of the entire body from the waist up and a single shaft, single drive, non tension adjustable leg exercising device. Other devices, such as those disclosed in U.S. Pat. Nos. 3,940,128 and 4,188,030, provide dual action cycles having interlinked upper and lower body exercising portions basically designed to provide simultaneous dual action exercise. Neither of these last two mentioned patents, however, teaches the application of a piston-cylinder coacting with a handlebar nor a high speed lower body exercising apparatus acting independently of the upper body exercising part. In both instances, the connection between exercise devices sets up an oscillatory movement at the foot operated exercise location which imparts motion to its complementary exercising device. Other exercising devices of note, although not as relevant as the aforementioned patents but nonetheless peripherally of interest, can be found in U.S. Pat. Nos. 2,382,841 and 4,275,882 wherein the former discloses a physiotherapeutic apparatus having a double reduction foot activated arrangement between crank and driven member and the latter relates to a home exercise gym in which hydraulic shock absorbers are attached to a handlebar-like member for exercising the arms in much the same manner as a weight lifter would bench press a weight.

The aforementioned discussion demonstrates that there are a number of cycle exercising devices available in the industry. None of the exercise cycles, however, provide an upper body exercising assembly with integral piston-cylinder separate and distinct from the lower body exercising feature of the cycle. Additionally, no other cycle provides a more compact multi-drive crank drive apparatus including a lightweight, high speed flywheel for providing a pedaling action smoother than that heretofore known in the art.

SUMMARY OF THE INVENTION

The present invention relates to an improved dual action stationary exercise cycle wherein a user can elect to independently or simultaneously exercise either the lower or the upper portion of the body. Lower body exercise can be achieved by activating the foot pedals of a multi-drive, multi-shaft apparatus mounted on the cycle frame. The cycle frame includes a pair of parallel tubular members having transverse stabilizers at the ends thereof supporting an upwardly opening U-shaped tubular body portion adapted to receive a seat and a handlebar assembly. In a preferred form the lower body exercising device includes a flywheel, with adjustable braking control, driven by a multi-sprocket, freewheel drive wheel combination which develops a multiple flywheel revolution per revolution of the foot pedals. Upper body exercise may be achieved by pushing or pulling the hand grips of a handlebar assembly mounted on the cycle frame wherein the assembly includes a handlebar rotatably mounted on a stem and coacting with a variable resistance piston-cylinder resistive to handlebar rotation.

The various features of novelty which characterize the invention are pointed out with particularity in the claims annexed to and forming a part of this disclosure. For a better understanding of the invention, its operating advantages and specific results obtained by its use, reference should be made to the accompanying drawings and descriptive matter in which there is illustrated and described a typical embodiment of the invention.

DETAILED DESCRIPTION OF THE PREFERRED EMBODIMENT

Figure 1:
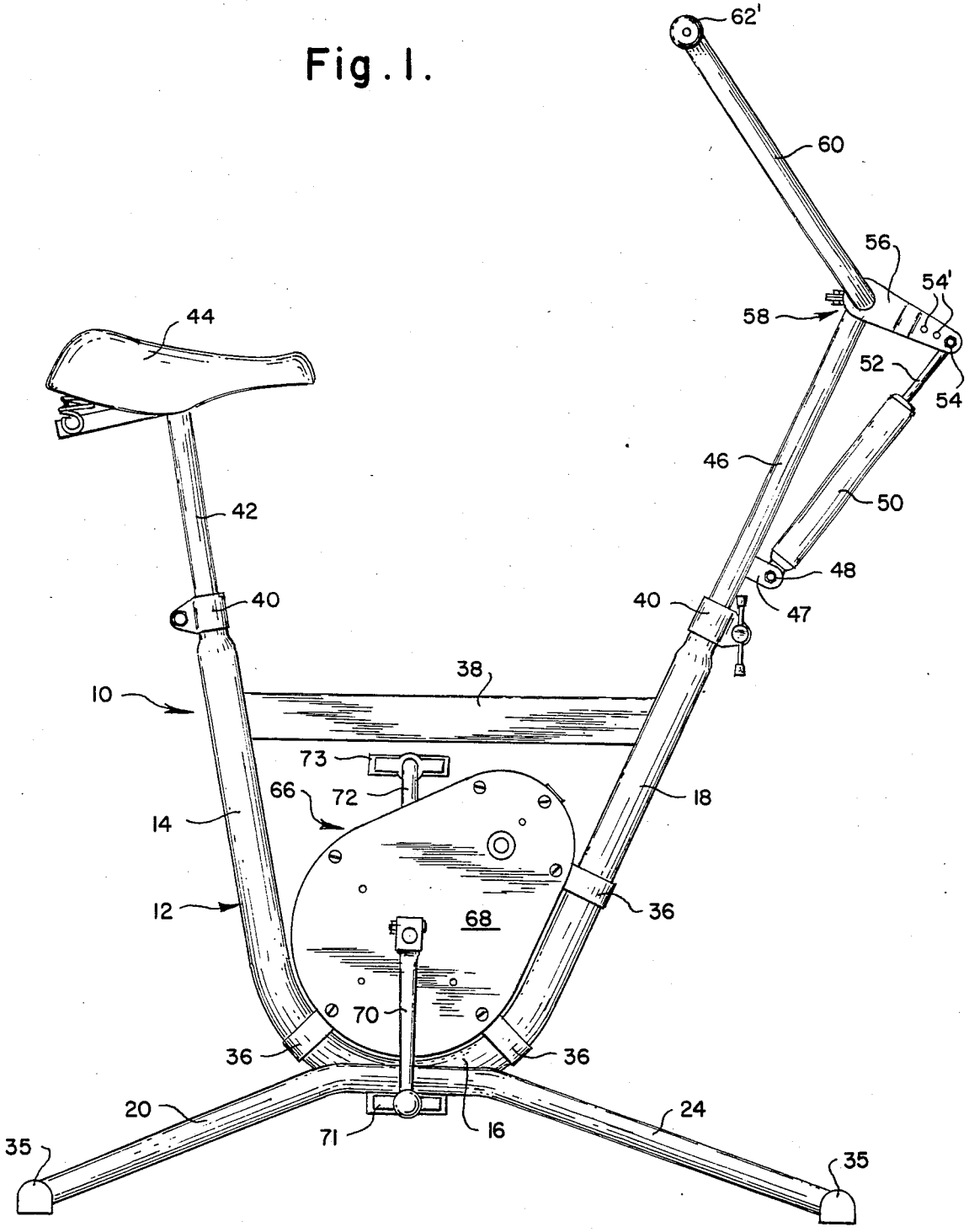
FIG. 1 is a left side elevation view depicting a dual action stationary exercise cycle in accordance with the principles of the present invention.
Figure 2:
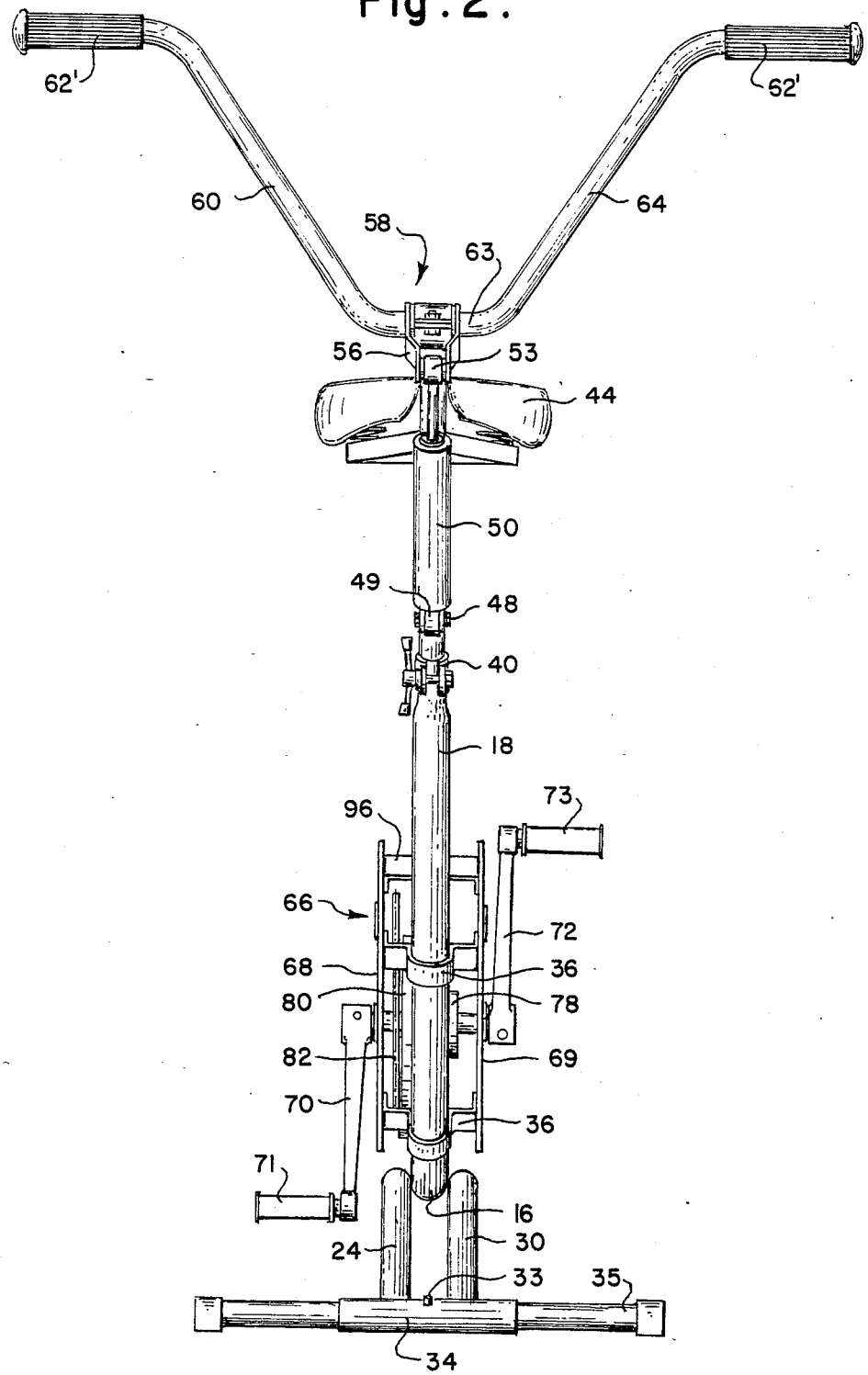
FIG. 2 is a front elevation view of the cycle illustrated in FIG. 1.
Figure 4:
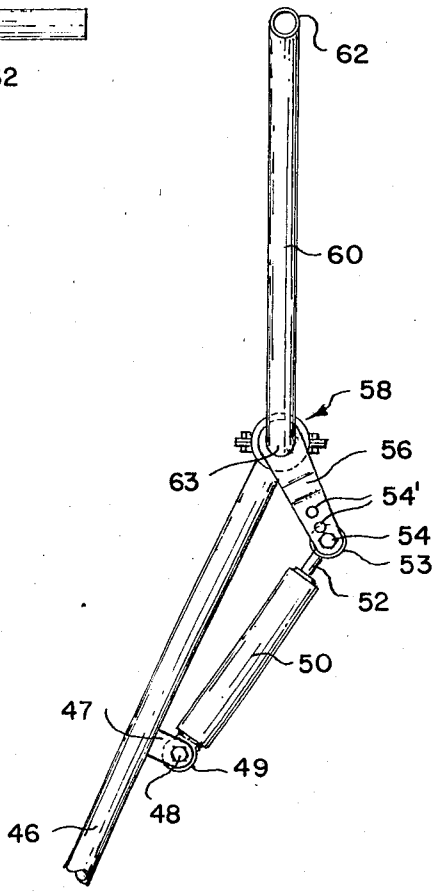
FIG. 4 is a left side elevation view of the assembly depicted in FIG. 3.
Figure 3:
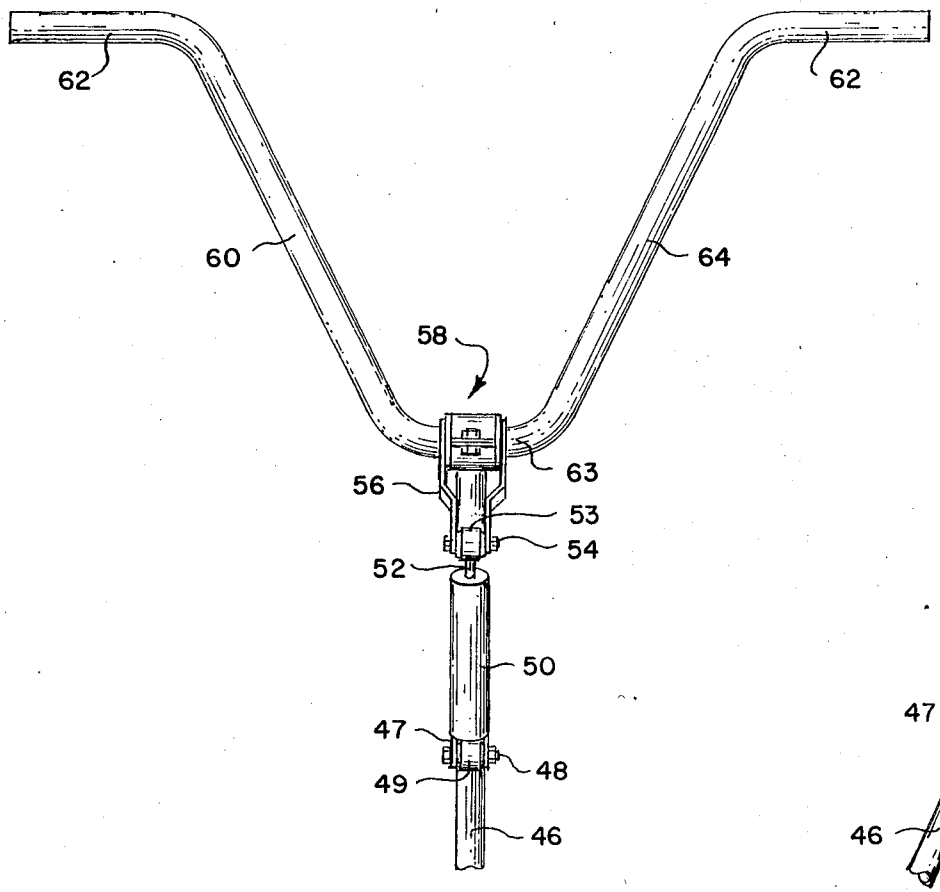
FIG. 3 is an enlarged partial front elevation view of a handlebar assembly similar to that depicted in the upper front portion of the cycle shown in FIG. 2.
Figure 5:
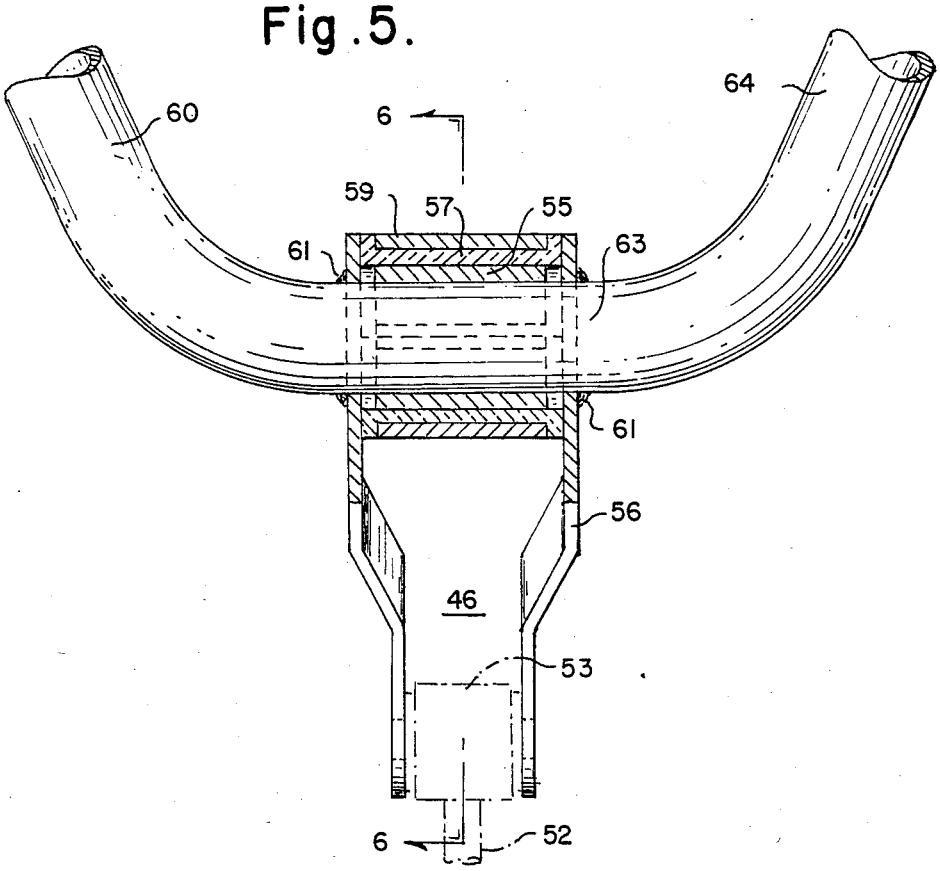
FIG. 5 is an enlarged detailed sectional view illustrating the assembly of FIG. 3 taken along line 5—5 of FIG. 6.
Figure 12:
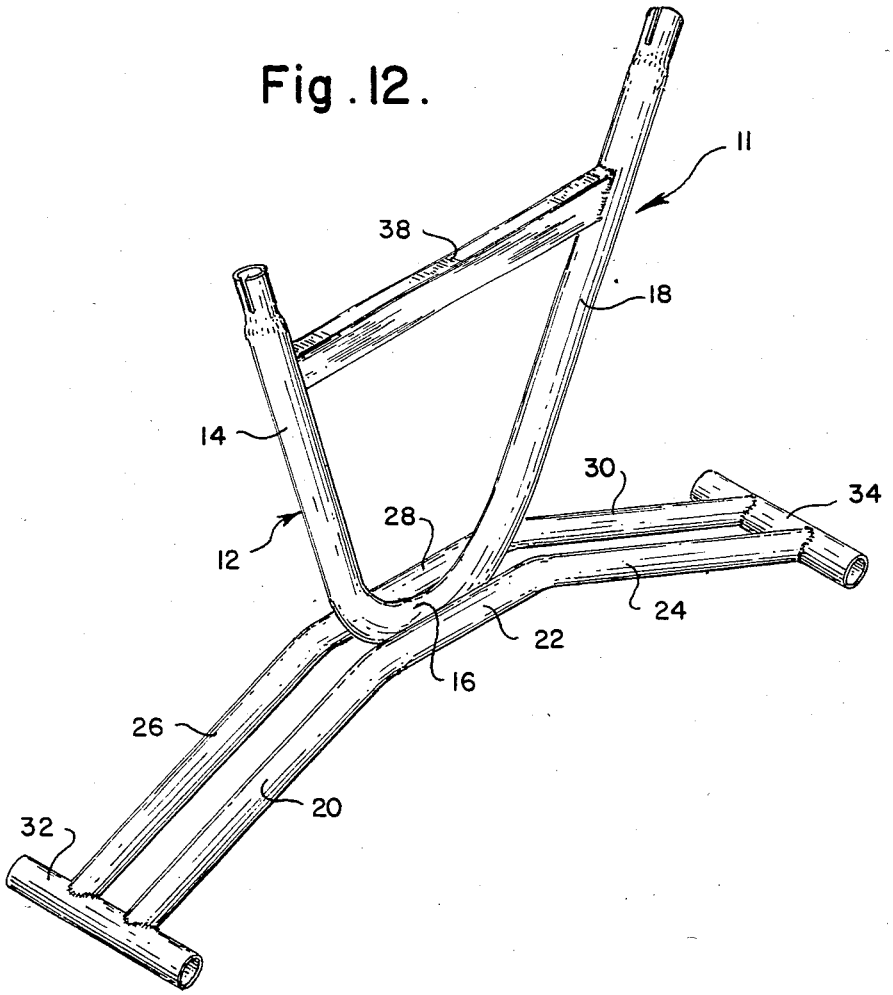
FIG. 12 is a perspective view of the frame portion of the cycle depicted in FIG. 1.

The description refers to the accompanying drawings in which like reference numerals refer to like parts throughout the several views, and in which, referring to FIG. 1, there is illustrated an embodiment of the invention depicting a left side elevation view of a dual action stationary exercise cycle 10. FIG. 2 provides a front elevation view of cycle 10 and FIG. 12 depicts a perspective view of frame portion 11 thereof. FIGS. 1, 2 and 12 should be viewed concurrently to appreciate the overall concept of the present invention while the remaining figures can be seen as providing detailed views of the various component parts of cycle 10.

Cycle 10 includes a frame portion 11 (FIG. 12) wherein a pair of tubular support members are located in spaced substantially parallel relationship supporting a generally U-shaped upwardly opening tubular body member 12. The parallel tubes, extending from the floor level location at the rear of cycle 10, include upwardly inclined and forwardly directed segments 20 and 26, intermediate substantially horizontal portions 22 and 28, and downwardly inclined and forwardly directed segments 24 and 30. The support members terminate at the front and rear floor level locations of the cycle. A pair of transverse stabilizer tubes 32 and 34 are connected, through welding or other suitable means, to the tubular support members at the terminal portions thereof. Stabilizers 32 and 34 may be extended over a greater floor area to achieve increased stability by placing stabilizer extension 35 inside each stabilizer tube and securing extensions 35 to stabilizer tubes 32 and 34 by a securing device such as lock screw 33. Tubular body member 12 includes an upwardly and rearwardly directed portion 14, a lowermost curved portion 16, an upwardly and forwardly directed portion 18, and a reinforcing member 38 connected to upright portions 14 and 18. Member 38 in effect acts as a stabilizer to retard movement of tubular portions 14 and 18 during activation of the upper body exercise portion of the cycle. Body member 12 at its lowermost portion 16 is secured, via welding or the like, to intermediate tubular portions 22 and 28 for support thereby. In a preferred arrangement, body member 12 is positioned between the parallel support members at the location of intermediate portions 22 and 28. Forwardly directed portion 18 of body member 12 is forwardly displaced from the vertical axis an angle ranging from slightly forward to about 35°, with a preferred angle of displacement being about 35° forward from the vertical. Portion 14 of body member 12 is adapted to internally receive tubular member 42 supporting a seat 44 thereabove, tube 42 being height adjustably secured to portion 14 by means of a screw clamp 40, or equivalent. Portion 18 of body member 12 is likewise adapted to height adjustably receive, as via clamp 40, a handlebar assembly including stem 46 and a handlebar comprising portions 60, 62, 63 and 64. Disposed about body member 12 near lowermost portion 16 is a foot actuated exercise drive device 66 secured to body 12 by employing a number of mounting clamps 36.

Figure 6:
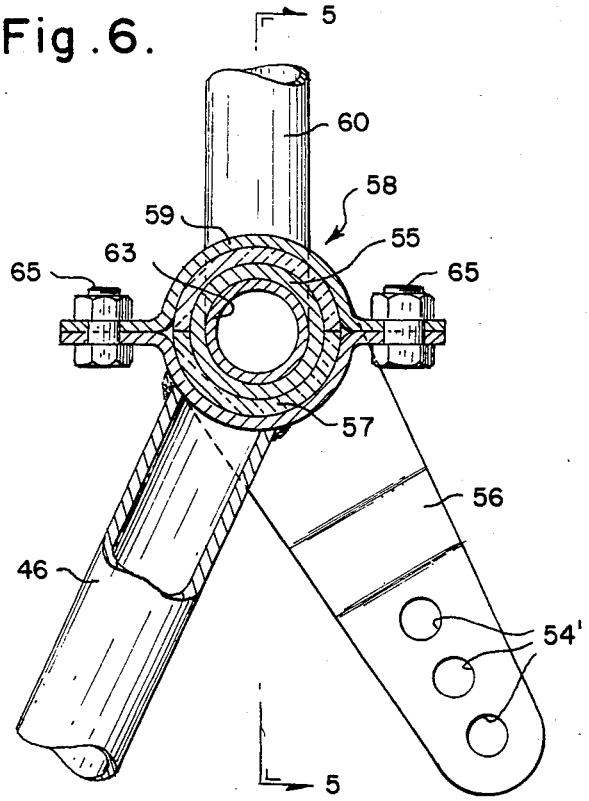
FIG. 6 is an enlarged detailed sectional view of the assembly similar to that of FIG. 5 taken along line 6—6 of FIG. 5.
Figure 7:
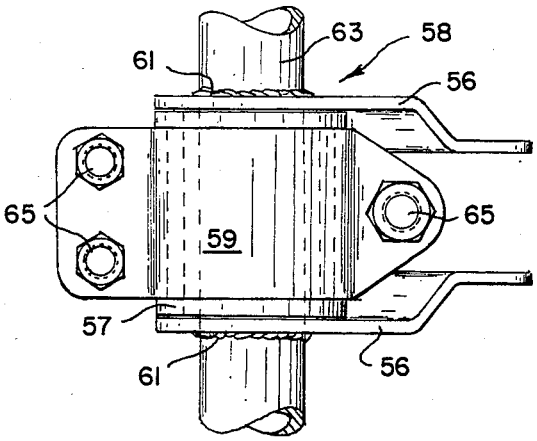
FIG. 7 is an enlarged detailed sectional view, in plan, of the central portion of the assembly shown in FIG. 3.
Figure 9:
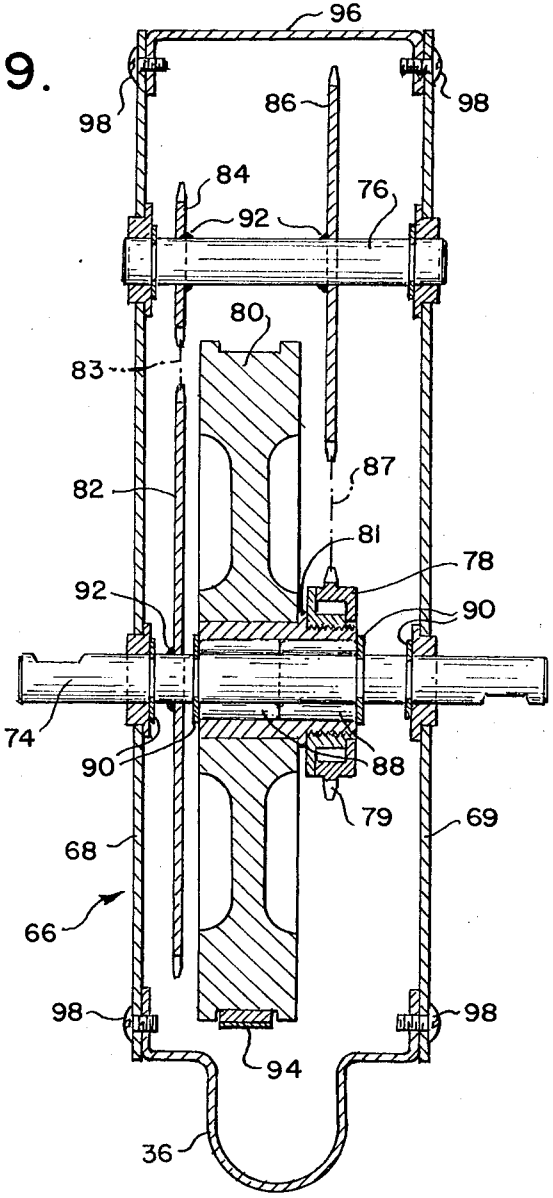
FIG. 9 is a cross sectional view of the lower body exercising device taken along line 9—9 of FIG. 8.
Figure 8:
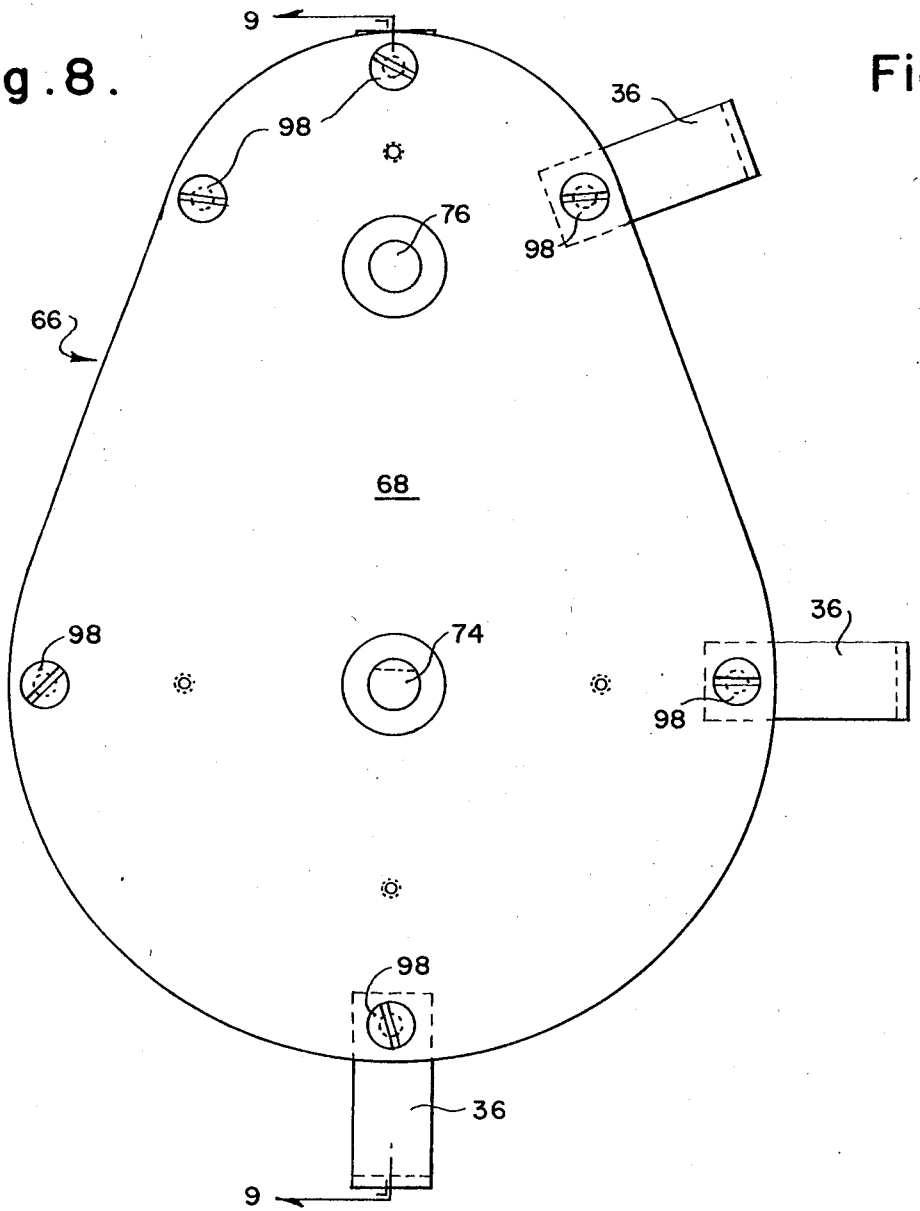
FIG. 8 is a partial enlarged front elevation view of a foot actuated lower body exercising device represented in FIG. 1.
Figure 10:
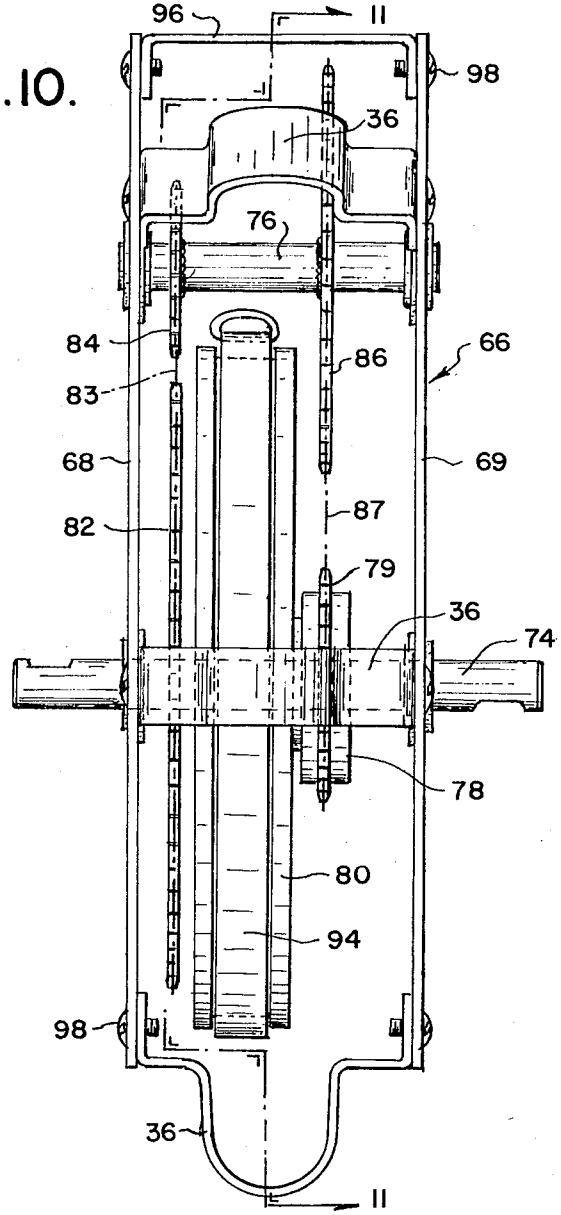
FIG. 10 is a right side elevation view of the exercising device of FIG. 8.
Figure 11:
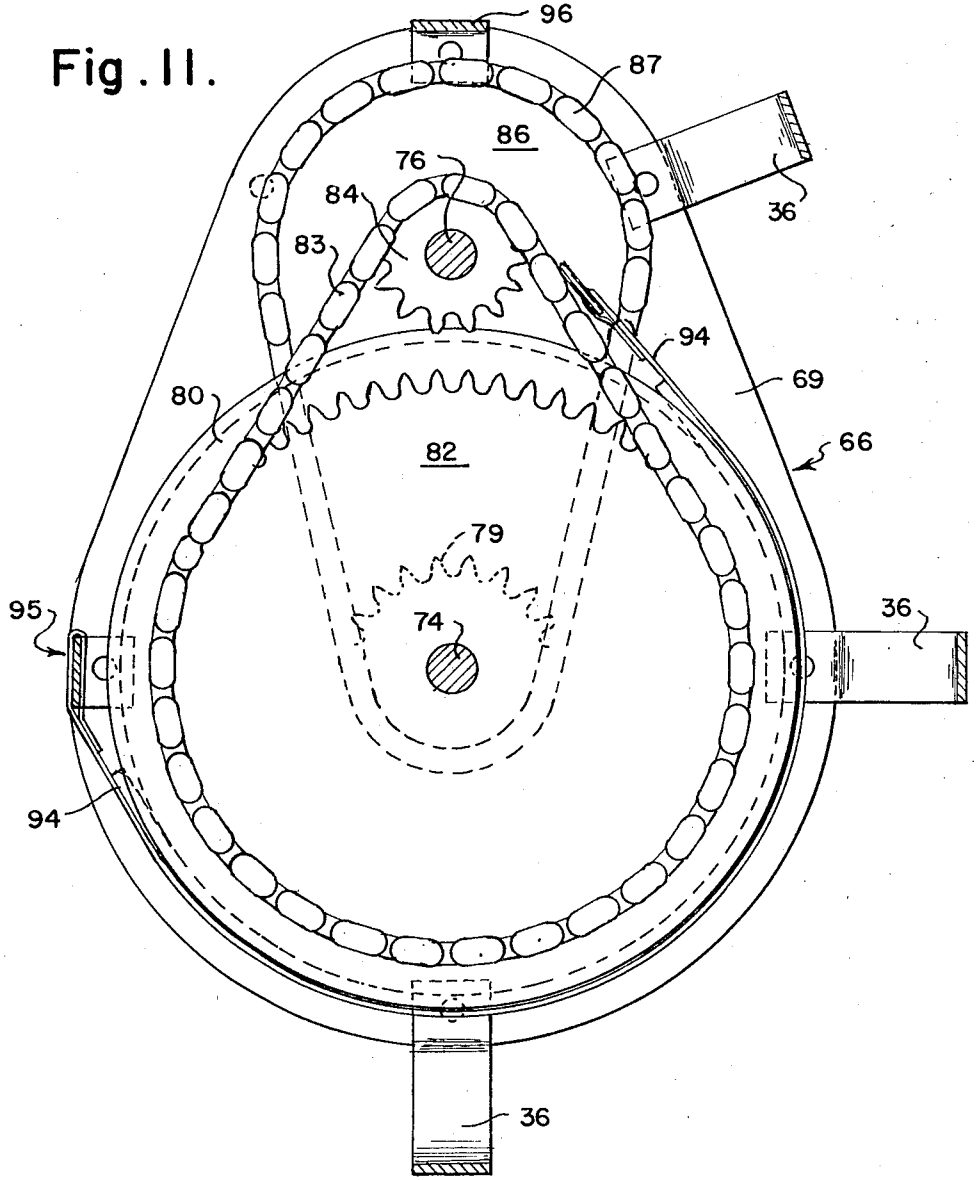
FIG. 11 is a sectional view of the exercising device taken along line 11—11 of FIG. 10.

Turning to FIGS. 3 through 7, one can readily observe detailed views of the handlebar assembly shown in FIG. 2 from above the area of mounting clamp 40 of tubular upright 18. Specifically, a handlebar comprising hand grip portions 62, upright portions 60 and 64, and medial segment 63 is rotatably mounted on stem portion 46 along medial segment 63 utilizing a mounting clamp 58. FIG. 6 shows a detailed cross-sectional view of mounting clamp 58 depicting upper and lower mounting portions 59 secured together by a plurality of threaded bolts and nuts 65 enclosing a wear sleeve 57, a medial segment reinforcing sleeve 55 and a portion of medial segment 63. Fixedly secured to medial segment 63 on each side of mounting clamp portions 59 is a bracket 56 welded at one end to medial segment 63 along weldment 61. The other end of bracket 56 is connected at 54, as with a nut and bolt coupling, to the end 53 of piston rod 52 of piston-cylinder 50. Bracket 56 may include a series of mounting ports 54' along its length to accommodate a plurality of piston rod to bracket connections. The other end 49 of piston-cylinder 50 is affixed to stem 46 via a threaded bolt and nut assembly 48 connecting end 49 to a bracket 47 protruding from stem 46. Typically, cylinder 50 will be a hydraulic piston-cylinder but equally applicable would be one having a gaseous working medium.

Referring now to FIGS. 8–11, therein is detailed the various component parts of the foot actuated exercise drive apparatus 66 as shown in FIGS. 1 and 2. The drive apparatus has a housing including spaced walls 68 and 69 joined by a plurality of mounting clamps 36 and spacer brackets 96 secured to walls 68 and 69 by screws 98. A drive shaft 74 extending through housing walls 68 and 69 and carried thereby, supports a threaded freewheel drive wheel 78 rotatably mounted thereon. Freewheel drive wheel 78 communicates with a flywheel 80, weighing approximately 13 pounds and likewise rotatably mounted on drive shaft 74, along a sleeve portion 81 threaded at the end thereof for engaging the mating threaded portion of drive wheel 78. Located between flywheel sleeve portion 81 and drive shaft 74 are roller bearings 88 to facilitate flywheel rotation about the shaft. Retaining rings 90 are positioned along shaft 74 to restrain the flywheel-drivewheel combination from moving longitudinally along shaft 74. Communicating with the outer periphery of flywheel 80 is a flexible, adjustable, tension control belt 94 carried by the housing at mounting 95. The belt is preferably made of felt lined nylon and provides variable resistance to flywheel rotation via frictional force generated at the flywheel/-belt interface. The belt is shown encircling a substantial portion of the flywheel and the adjustable tension control aspect thereof, not depicted, may be a spring, a cable or the like. Also included on shaft 74 is a sprocket wheel 82 spaced from flywheel 80 and affixed to shaft 74 via weldment 92. Not depicted in FIGS. 8–11 but shown in FIGS. 1 and 2 are a pair of crank arms 70 and 72 with a pedal 71 or 73 connected to the end of each arm, an arm and pedal combination being mounted proximate the ends of drive shaft 74. Spaced from drive shaft 74 is an idler shaft 76 which includes two spaced sprocket wheels 84 and 86 fixedly mounted to shaft 76 via weldment 92. A first drive means 83, in this instance a chain link drive, engages sprocket wheels 82 and 84. A second drive means 87, also herein a chain link drive, engages sprocket wheel 86 and freewheel drive wheel 78 with integral teeth 79. It should be understood that gears, pulleys or the like could be used in place of sprocket wheels and likewise that belts and ropes could replace the chains.

During operation of the upper body exercise portion of cycle 10, a user from a sitting position on seat 44 would grasp a pair of hand grips 62' and either push or pull on the handlebar in an attempt to rotate the handlebar about its axis of rotation, that is, about the connection of medial segment 63 to stem 46. Resistance to rotational movement of the handlebar will be provided by variable resistance piston-cylinder 50 connected at one end to stem 46 and at the other end to bracket 56 welded to segment 63. The arc traversed by the handlebar will be determined by piston displacement. The force required to move the piston is constant for a given cylinder mounting, however, relocation of the bracket to piston rod connection utilizing a different connecting port will change the force required to push or pull the handlebar wherein the required force diminishes as the connection approaches the medial segment. Additionally, the force required to move the piston in either direction may be varied or constant, namely, resistance to outward movement of the piston may be equal to the maximum capacity of the cylinder while resistance to return movement might be negligible, the converse might be realized or the force might be equally resistive in both directions. Thus the force imparted by the cylinder coacting with the bracket might provide resistance to rotational movement of the handlebar in the forward or rearward direction equal to or from 0 to 100% of the resistive capacity of the cylinder, exerted through the piston, or it might be applied equally in each direction.

During operation of the lower body exercising portion of the cycle, a user, likewise from a sitting 25 position on seat 44, would, in a manner similar to that of pedaling a bicycle, activate the foot pedals and crank arms mounted on drive shaft 74 to thereby impart rotational movement to the drive shaft and sprocket wheel 82, which, in turn, via chain drive 83 communicating with sprocket wheel 82, would simultaneously turn sprocket wheel 84, idler shaft 76 and sprocket wheel 86, causing sprocket wheel 86, in communication with chain drive 87, to engage freewheel drive wheel 78 to drive flywheel 80. The freewheel drive wheel, a type commonly found in use in the bicycle and exercise cycle industry, is similar to a rachet device employed with socket wrench type tools. The freewheel locks when rotated in one direction but offers no resistance to rotational movement in the opposite direction. Therefore, when the threaded central portion of the freewheel is matingly engaged with the threaded portion of the sleeve or center hub of the flywheel, the flywheel is driven in one direction by the freewheel and, since the freewheel offers no resistance to rotational movement in the opposite direction, the user can stop pedaling without causing the flywheel to stop rotating. The strap or belt encircling the flywheel may be adjusted to provide a frictional or braking force resistive to flywheel rotation, thus varying the leg power necessary to drive the flywheel while simultaneously varying the exercise achieved. The belt is an improvement over the roller or calipher brake type devices commonly used to restrain flywheel rotation, namely, the flexible, felt-lined, nylon belt used with a high speed flywheel provides improved braking smoothness via constant tension control by flexing slightly to compensate for the slight imperfections commonly found on the braking contact surface of a flywheel.

Flywheel rotation per pedal cranking, that is, per rotation of the drive shaft, can be varied by varying the relative relationship of sprocket wheels per drive means. For example, assume that the first drive means includes a 48-tooth sprocket wheel fixedly mounted on the drive shaft and that this wheel drives a 12-tooth sprocket wheel fixedly mounted on the idler shaft and further assume that the second drive means to includes a 36-tooth sprocket wheel driving a 16-tooth freewheel sprocket wheel. Adual drive means so contemplated would cause the flywheel to rotate approximately six times per revolution of the drive shaft or pedal rotation, namely, the 48-tooth to 12-tooth relationship of the first drive means would yield a 4:1 drive ratio while the second drive means of 36-tooth to 16-tooth relationship would yield a $2\frac{1}{4}$:1 drive ratio. Thus by adding ratios, one would achieve a drive ratio of $6\frac{1}{4}$:1. This ratio can be adjusted by changing the relationship between sprocket wheels, namely, an increase in flywheel rotation per cranking would be achieved by increasing the wheel teeth ratios and a decrease achieved by decreasing the ratios. A high ratio of flywheel revolutions per pedal cranking develops an inertia or energy buildup which provides a smooth ride by eliminating the so-called high and low spots normally encountered as one pedal passes through its lowermost point while the other pedal is passing through the highermost point during crank rotation. Practicably speaking, a drive ratio for an exercise cycle should range from a low of about two to a high of about eight. The higher end of the desired ratio could be achieved by utilizing a one chain multi-sprocket drive but such would require a very large sprocket or sprockets. Alternatively, a desired drive ratio might be achieved utilizing three or more drive chains but this would require an increased number of smaller sprockets and idler shafts. However, the double reduction arrangement between the cranks and drive member as herein described provides an improved, compact lower body exercising device unlike that found in the industry.

While in accordance with the provisions of the statutes there is described herein a specific embodiment of the invention, those skilled in the art will understand that changes may be made in the form of the invention covered by the claims appended hereto without departing from the scope and spirit thereof, and that certain features of the invention may sometimes be used to an advantage without corresponding use of the other features.

The embodiments of the invention in which an exclusive property or privilege is claimed are defined as follows:

1. A dual action stationary exercise cycle comprising: a frame, a foot actuated exercising drive means mounted on said frame, a tubular member for supporting a seat thereon, means for height adjustably connecting said tubular seat supporting member to said frame, a handlebar assembly, said assembly including a mounting stem and a handlebar, said handlebar having a transverse medial segment and a pair of hand grips offset from said medial segment, means for pivotally connecting said handlebar at the medial segment thereof to said mounting stem, said pivotal connecting means including clamping means for rotatably securing said medial segment, means for height adjustably connecting said handlebar assembly to said frame, a variable resistance piston-cylinder, extension means interconnecting one end of said piston-cylinder and the medial segment of said handlebar, means for connecting the other end of said piston-cylinder to said mounting stem, said piston-cylinder coacting with said medial segment for providing resistance to pivotal movement of said handlebar, said drive means and said handlebar being in spaced and operatively disassociated relationship, whereby lower body exercise can be achieved by foot actuating said drive means while upper body exercise can be achieved, either simultaneously or independently, by pushing or pulling said hand grips.

2. The exercise cycle according to claim 1 wherein the resistance imparted by said cylinder to pivotal movement of said handlebar in the forward direction varies from 0 to 100% of the resistive capacity of said cylinder.

3. The exercise cycle according to claim 2 wherein resistance to rearwardly directed pivotal movement of said handlebar varies from 0 to 100% of the resistive capacity of said cylinder.

4. The exercise cycle according to claim 3 wherein the resistive force of said cylinder is applied equally to the forward and rearward pivotal movement of said handlebar.

5. The exercise cycle according to claim 1, said exercising drive means comprising: a housing, a drive shaft, at least one idler shaft spaced from said drive shaft, said drive shaft and said idler shaft being rotatably carried by said housing, a freewheel drive wheel rotatably mounted on said drive shaft, a first drive means engaging said drive shaft and said idler shaft, and a second drive means engaging said idler shaft and said drive wheel.

6. The exercise cycle according to claim 5 further including a flywheel rotatably mounted on said drive shaft communicating with said drive wheel, said drive wheel imparting rotational movement to said flywheel.

7. The exercise cycle according to claim 6 wherein said flywheel weighs approximately thirteen pounds.

8. The exercise cycle according to claim 6 further including crank means disposed proximate the ends of said drive shaft for providing rotational movement thereto, said crank means including a pair of arms with a pedal connected to the end thereof.

9. The exercise cycle according to claim 6 further including adjustable tension means communicating with said flywheel for providing variable resistance to flywheel rotation.

10. The exercise cycle according to claim 9 wherein said tension means is a felt lined belt.

11. The exercise cycle according to claim 5 wherein said drive shaft and said idler shaft are disposed in substantially parallel relationship.

12. The exercise cycle according to claim 8 further including a sprocket wheel fixedly mounted on said drive shaft and communicating with said first drive means.

13. The exercise cycle according to claim 12 further including two spaced sprocket wheels fixedly mounted on said idler shaft, one of said sprocket wheels communicating with said first drive means, the other of said sprocket wheels communicating with said second drive means.

14. The exercise cycle according to claim 13 wherein flywheel rotation is on the order of from about two to about seven revolutions per revolution of said drive shaft.

15. The exercise cycle according to claim 1 wherein said extension means includes means for selectively positioning said one end of said piston-cylinder along the length of said extension means.

* * * * *